US006595169B2

(12) United States Patent
Raffenberg et al.

(10) Patent No.: US 6,595,169 B2
(45) Date of Patent: Jul. 22, 2003

(54) INTERNAL COMBUSTION ENGINE HAVING ADJUSTABLE CO CHARACTERISTIC CURVE

(75) Inventors: Michael Raffenberg, Fellbach (DE); Heinz Hettmann, Schorndorf (DE); Heiko Rosskamp, Adelberg (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/059,845

(22) Filed: Jan. 29, 2002

(65) Prior Publication Data

US 2002/0100438 A1 Aug. 1, 2002

(30) Foreign Application Priority Data

Feb. 1, 2001 (DE) ..... 101 04 446

(51) Int. Cl.[7] ..... F02B 33/04
(52) U.S. Cl. ..... 123/73 A; 123/73 R
(58) Field of Search ..... 123/73 R, 73 A, 123/73 PP

(56) References Cited

U.S. PATENT DOCUMENTS 4,814,114 A * 3/1989 Charmley ..... 261/35

FOREIGN PATENT DOCUMENTS

DE 19900445 A1 7/2000

* cited by examiner

*Primary Examiner*—Noah P. Kamen
(74) *Attorney, Agent, or Firm*—R W Becker & Associates; R W Becker

(57) ABSTRACT

An internal combustion engine, for example a two-stroke engine having scavenging collection, is provided. The combustion chamber formed in the cylinder is delimited by a reciprocating piston. A fuel/air mixture prepared in the Venturi section of a diaphragm carburetor is supplied to the engine. The air portion of the mixture is conveyed to the Venturi section via an intake channel, and the fuel portion is conveyed to the Venturi section via a main nozzle path that branches off from a fuel-filled control chamber to which fuel is supplied via a fuel line and a feed valve that is controlled by a control diaphragm that delimits the control chamber. A device is provided for varying the air portion and/or the fuel portion at full load. Connected to the device is a control unit that receives, as an input variable, an operating parameter of the engine that varies as a function of engine speed. The device is actuated as a function of the output signal of the control unit.

18 Claims, 6 Drawing Sheets

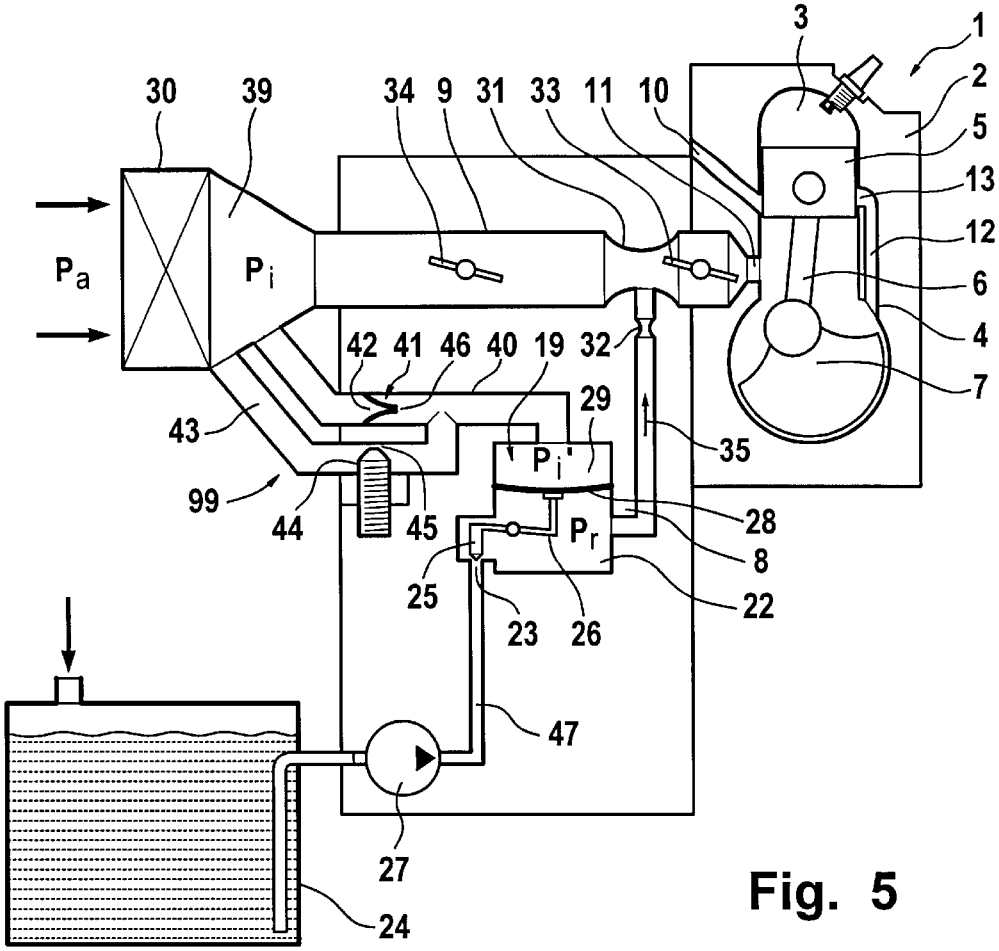
Fig. 5
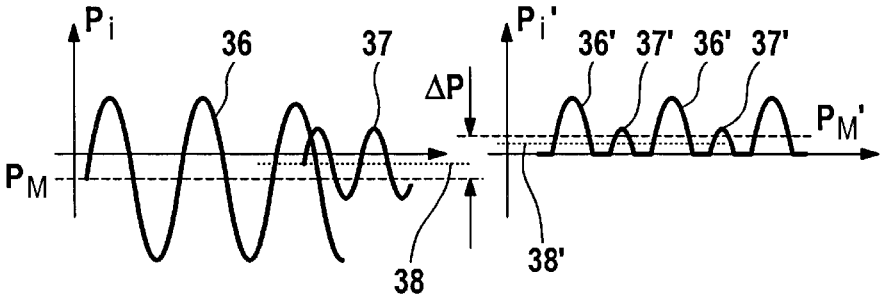
Fig. 6
Fig. 6'

INTERNAL COMBUSTION ENGINE HAVING ADJUSTABLE CO CHARACTERISTIC CURVE

BACKGROUND OF THE INVENTION

The present invention relates to an internal combustion engine, especially for a portable, manually-guided implement such as a power chain saw, a cut-off machine, a brushcutter, a trimmer, or the like, and has a combustion chamber that is formed in the cylinder of the engine and that is delimited by a reciprocating piston that drives a crankshaft that is rotatably mounted in a crankcase. A fuel/air mixture prepared in the Venturi section of a diaphragm carburetor is supplied to the internal combustion engine. The air portion of the mixture is supplied to the Venturi section via an intake channel, and the fuel portion of the mixture flows to the Venturi section via a main nozzle path that branches off from a fuel-filled control chamber that is supplied with fuel via a fuel line and a feed valve, which is controlled by a control diaphragm that delimits the control chamber.

An engine of this general type is known from DE 199 00 445 A1. The fuel/air mixture is drawn into the crankcase and, as the piston moves downwardly, is conveyed into the combustion chamber via transfer channels. To reduce the scavenging losses, in particular the transfer channels that are disposed close to the exhaust communicate via diaphragm valves with air channels that supply clean air, so that the rich mixture is shielded from the exhaust by fuel-free air that flows in a contemporaneous manner. This known engine can be operated as an engine having scavenging collection or also as an engine having charge stratifying, and exhibits a very good exhaust gas characteristic at low fuel consumption.

Because of the system, the mixture becomes leaner under full load and dropping speed, since in such an operating state an over proportional amount of fuel-free air is drawn in via the bypass air channels. The engine becomes starved, and its power drops.

It is therefore an object of the present invention to provide an improved internal combustion engine of the aforementioned general type that even at a speed that drops under full load ensures a complete combustion with a powerful output.

BRIEF DESCRIPTION OF THE DRAWINGS

This object, and other objects and advantages of the present invention, will appear more clearly from the following specification in conjunction with the accompanying schematic drawings, in which:

FIG. 5 is a schematic operational diagram of the two-stroke engine of FIG. 1;

FIG. 6 schematically illustrates the pulsating pressure in the intake channel;

FIG. 6 schematically illustrates the pressure distribution subsequent to a one-way valve;

SUMMARY OF THE INVENTION

Figure 1:
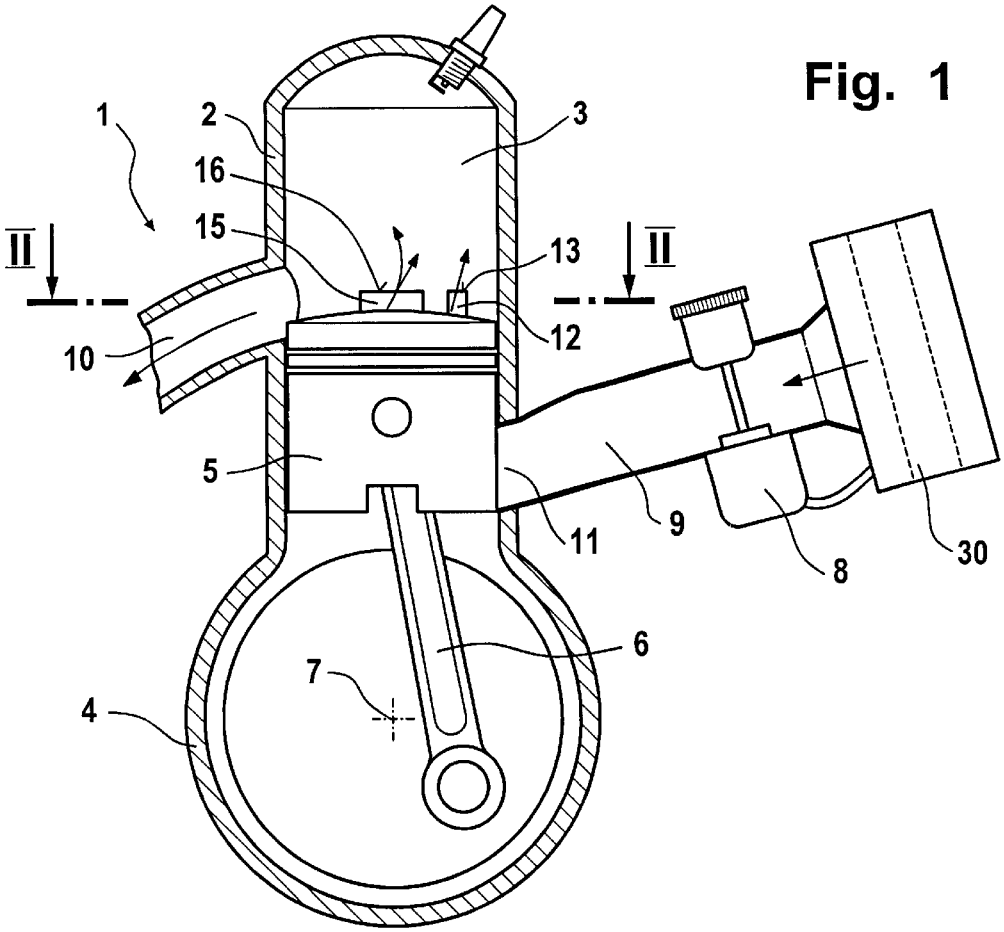
FIG. 1 is a cross-sectional view through a two-stroke engine having a scavenging collection.
Figure 2:
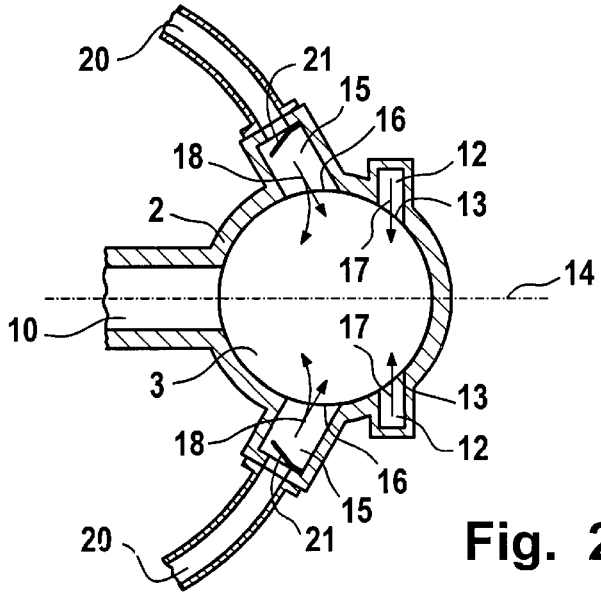
FIG. 2 is a cross-sectional view taken along the line II—II in FIG. 1.

To adapt the composition of the mixture at full load as a function of engine speed, the internal combustion engine of the present invention is provided with means for varying the air portion and/or the fuel portion at full load. For this purpose, a control unit is provided that is connected to the means for varying and to which is supplied, as an input variable, an operating parameter of the internal combustion engine that varies as a function of engine speed. As a function of the output signal of the control unit, the means for varying is actuated in such a way as to establish, under full load, an approximately uniform lambda in the combustion chamber of the internal combustion engine over the entire speed range thereof.

The carbon monoxide portion that is to be determined in the exhaust gas is a characteristic parameter for the value lambda. The flatter that the CO characteristic curve can be set the more constant is lambda at a speed that drops under full load (see FIG. 4). The carbon monoxide portion is advantageously set in a range between 0.5% to 11%. For this purpose, to shift the characteristic curve in the lower speed range, the fuel/air mixture is made richer, whereby as a control magnitude a pressure signal is utilized that is preferably derived from the intake channel. The control unit, which is advantageously embodied as a mean pressure definer or a differential pressure definer, processes the supplied pressure signal and makes available a derived pressure signal as an output signal that is to be used indirectly or directly to control the mixture proportions.

Thus, the derived pressure signal can be sent indirectly or directly as an output signal to the control diaphragm of the diaphragm carburetor, whereby the magnitude of the pressure signal can be adjusted in order to achieve the desired shifting of the CO characteristic curve. The output signal can also be utilized to control an adjustment member that controls a flow restrictor that varies the air portion, whereby the flow restrictor is preferably a Venturi section, for example the Venturi section in the intake channel, which Venturi section is adjustable in cross-sectional area.

Pursuant to a further specific embodiment of the present invention, the output signal of the control unit can be an air mass stream that is supplied to the main nozzle path leading from the control chamber to the Venturi section in the intake channel. The diaphragm carburetor is set in such a way that under full load and high speed it prepares the desired mixture composition. If under full load the speed drops, the air mass stream is reduced by the control unit, so that an increased discharge of fuel is provided, in other words, an enriching of the mixture is effected to compensate for the over proportional amount of air that is supplied via the air channel.

Further specific features of the present invention will be explained in detail subsequently.

DESCRIPTION OF PREFERRED EMBODIMENTS

Referring now to the drawings in detail, the internal combustion engine that is schematically illustrated in FIGS.

1 and 2 is preferably a single cylinder engine that operates pursuant to the two-stroke principle and can be operated as an engine having scavenging collection or charge stratifying. Such a two-stroke engine is advantageously utilizable as a drive engine in portable, manually-guided implements such as power chain saws, cut-off machines, brushcutters, hedge trimmers, or the like.

The basic construction of the internal combustion engine 1 comprises a cylinder 2, a crankcase 4, as well as a piston 5 that reciprocates in the cylinder 2. The piston 5 delimits a combustion chamber 3 in the cylinder 2 and by means of a connecting rod 6 drives a crankshaft 7 that is rotatably mounted in the crankcase 4. The exhaust gases are withdrawn from the combustion chamber 3 via an exhaust means 10. The fuel/air mixture that is necessary for operation of the engine is prepared in the Venturi 31 (see, for example, FIG. 5) of a diaphragm carburetor 8, and is supplied to the crankcase 4 via an intake channel 9 and an inlet 11. In the illustrated embodiment, the crankcase is connected with the combustion chamber 3 by means of four transfer channels 12 and 15. The inlet windows 13,16 of the transfer channels 12,15, which inlet windows open out into the combustion chamber 3, are disposed approximately diametrically opposite one another relative to an axis of symmetry 14.

As viewed in the circumferential direction of the cylinder 2, the inlet windows 13 of the transfer channels 12 are disposed approximately opposite the exhaust means 10, while the inlet windows 16 of the transfer channels 15 are disposed close to the exhaust means. In the vicinity of the inlet windows 16, the transfer channels 15 communicate via a diaphragm valve 21 with an external air channel 20, via which exclusively fuel-free air is supplied to the transfer channel 15. It can be expedient to also supply fuel-free air to the transfer channels 12 that are remote from the exhaust means.

The piston 5, in a manner known per se, controls the exhaust means 10, the inlet 11, as well as the inlet windows 13 and 16 of the transfer channels 12 and 15. During an upward movement of the piston 5, all of the channels that open out into the combustion chamber 3 are closed, whereas the inlet 11 of the diaphragm carburetor 8 is open to the crankcase 4. As a consequence of the upwardly moving piston 5, there results in the crankcase 4 an underpressure or partial vacuum, which is compensated for by an intake of a fuel/air mixture via the inlet 11. Since the transfer channels 12 and 15 are permanently open to the crankcase 4, the underpressure that results in the crankcase 4 at the same time effects an intake of air via the air channels 20 and the diaphragm valves 21, which are open due to the pressure conditions, into the transfer channels 15 that are close to the exhaust means. After an intake process, essentially pure air is therefore present in the transfer channels 15.

After ignition of the compressed mixture in the combustion chamber 3, which ignition is effected in the upper dead center position, the piston 5 is moved downwardly by the pressure of the explosion in a direction toward the crankcase 4, whereby, due to the position of the inlet windows 13 and 16, the exhaust means 10 is initially opened and a portion of the pressurized exhaust gases escapes. During the further downward movement of the piston 5, the inlet windows 13 and 16 of the transfer channels 12 and 15 open, whereby exclusively the rich fuel/air mixture that is drawn into the crankcase 4 flows in via the channels 12. The volume of air previously collected in the transfer channels 15 that are close to the exhaust means is pushed into the combustion chamber 3 by the following mixture via the inlet window 16. The air, which enters in the direction of the arrows 18, is disposed in front of the exhaust means 10 in the manner of a protective curtain, so that the mixture that enters in the direction of the arrows 17 is prevented from escaping. The scavenging losses are essentially formed by the fuel-free air.

Figure 3:
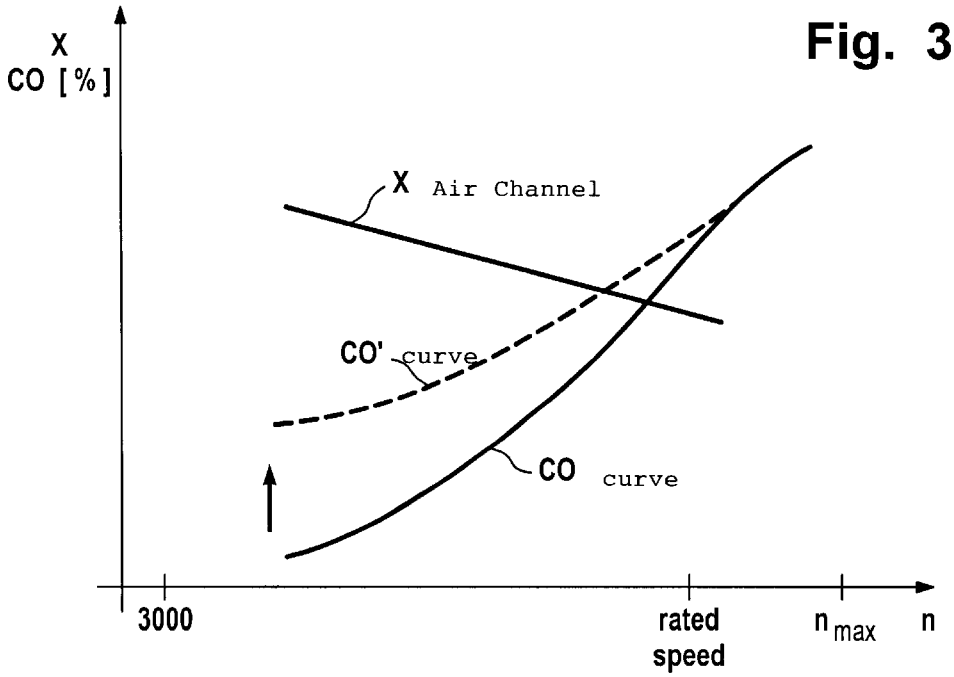
FIG. 3 is a graph plotting a carbon monoxide characteristic curve versus the speed at full load.

As schematically illustrated in FIG. 3, the carbon monoxide portion CO in the exhaust gas varies considerably as a function of the speed "n" of the internal combustion engine 1. Thus, for example with an engine having scavenging collection as in FIG. 1, a CO curve results that drops significantly under full load to low speeds; this leads to a significantly leaner mixture since at the same time an over proportional amount of air is supplied via the bypass air channel 20. The engine exhibits a significant loss of power.

Figure 4:
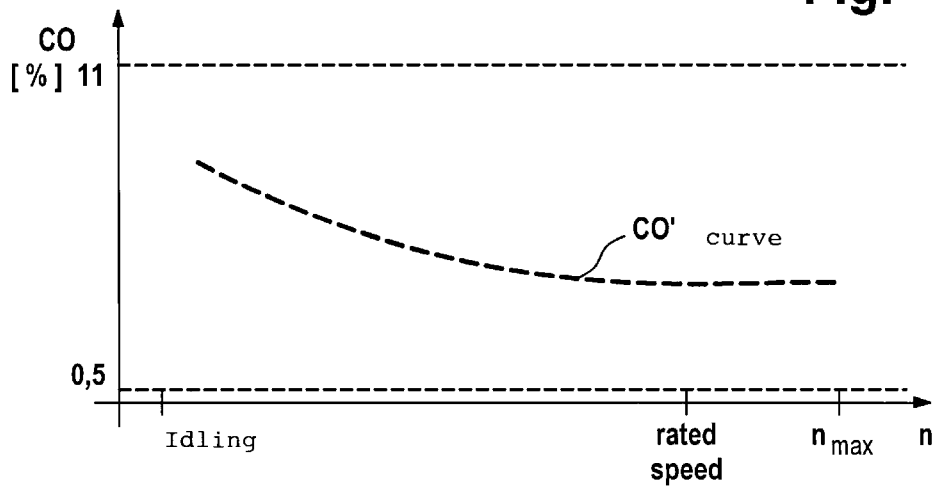
FIG. 4 is a graph of a desired CO characteristic curve.

A flat CO curve as illustrated in FIG. 4 is desired over the entire speed range "n" of the internal combustion engine. If such a flat CO curve can be set or obtained, there results over the entire speed range of the internal combustion engine, at full load, a largely constant lambda in the combustion chamber 3. For this purpose, means 19 (FIGS. 5,7,8,9) are provided which are controlled by a control unit 99 in order, under full load, to vary the air portion and/or the fuel portion in such a way that a flat CO curve results. In this connection, as described in detail in the following specific embodiments, there is conveyed to the control unit, as an input variable, an operating parameter of the internal combustion engine that varies as a function of the speed, so that the control unit can form an output signal that controls the means 19 in such a way that in the combustion chamber 3 of the internal combustion engine 1, under full load, an approximately uniform lambda is established over the entire speed range "n" of the engine.

In a first embodiment as illustrated in FIG. 5, the output signal of the control unit 99 is sent to the control diaphragm 28 of the diaphragm carburetor 8. The control diaphragm 28 delimits a fuel-filled control chamber 22 to which fuel is supplied from a fuel tank 24 over a fuel line 47 via a feed valve 23 using a fuel pump 27. In this connection, the valve member 25 is controlled by the control diaphragm 28 via a lever mechanism 26.

The output signal of the control unit 99 is present as a pressure signal and is sent to a compensation chamber 29 on the dry side of the control diaphragm 28. The control unit 99 comprises a first flow path 40 between the compensation chamber 29 and the clean air chamber 39 of the air filter 30. Similar pressure conditions exist in the clean air chamber 39 as do in the intake channel 9 and as are reproduced in FIG. 6. Disposed in the flow path 40 is a check valve 41 that is embodied as a duck-bill valve 42 and that effects a raising of the average pressure value $P_M$ to $P'_M$. Under full load and low speed, there results the pulsation curve 36 having pronounced amplitudes shown in FIG. 6, so that an average pressure value $P_M$ results upstream of the check valve 41. Downstream of the check valve 21 there occur merely the pressure peaks 36', as shown in FIG. 6', which lead to an average pressure value $P'_M$ that is greater than the average pressure value $P_M$ in the clean air chamber 39 by the value $\Delta P$. At high speeds there occurs in the clean air chamber 39 a pulsation curve 37, which translates into an average pressure value 38 that is indicated by a dotted line. Downstream of the duck-bill valve 42, only small pressure peaks 37' (FIG. 6') are effective; the pressure peaks 37' lead to an average pressure value 38' that is only slightly greater than the average pressure value 38 of the pulsation curve 37. At high speeds, the low average value shift has hardly any effect upon the conveyance of fuel, whereas when the speed drops and the pulsation curve is very pronounced, the average value increase by AP leads to an increase in the supply of fuel.

During operation of the internal combustion engine, air for combustion is supplied via the air filter, whereby due to the pressure conditions in the Venturi section 31, fuel is discharged via the main nozzle 32 in the direction of the arrow 35. The mixture formed thereby enters the crankcase 4 via the inlet 11, whereby for control purposes a butterfly valve 33 is disposed in the region of the Venturi section 31, and upstream of the butterfly valve a choke valve 34 is provided.

The fuel flowing in the direction of the arrow 35 leads to a control pressure $P_r$ in the control chamber 22, with this pressure effecting a deflection of the control diaphragm 28 and hence an opening of the feed valve 23. Fuel flows out of the fuel tank 24 over the fuel line 47. If under full load the speed drops, the average pressure value $P_M$ in the clean air chamber 39, or in the intake channel 9, drops, which leads to a reduced discharge of fuel. Since due to the control unit 99, which is embodied as a mean pressure definer, the average pressure value $P'_M$ is raised, the control diaphragm 28 is actuated in the sense of an opening of the feed valve 23, so that an increased amount of fuel can flow and can be discharged via the main nozzle 32. The mixture that enters via the inlet 11 is richer, thereby compensating for the larger quantity of air that is supplied via the air bypass 20. The carbon monoxide curve CO is raised in the direction of the arrow (see FIG. 3) toward the course of the characteristic curve CO', as a result of which an approximately uniform lambda can be maintained in the combustion chamber.

To conform the average pressure value $P'_M$ present in the compensation chamber 29 to the respective operating condition, the control unit 99 has a second flow path 43, which detours the check valve 41 as a bypass. Disposed in the flow path 43 is a throttle or pressure-regulating valve 44, so that there results a time-delayed adaptation of the average pressure value $P'_M$ to the respective stationary state of operation of the internal combustion engine. The cross-sectional area 45 of the pressure-regulating valve 44 is less than the cross-sectional area 46 of the flow of the check valve 41. The cross-sectional area 45 of the pressure-regulating valve is preferably several times less than the cross-sectional area 46 of the flow.

In the embodiment illustrated in FIG. 5, the check valve 41 is switched open toward the compensation chamber 29; in this way, the raising of the carbon monoxide curve is achieved under full load and low speed. If the engine has an uncorrected CO curve which drops in the direction toward high speeds, an appropriate compensation in high speed ranges can be achieved by reversing the check valve 41.

Figure 7:
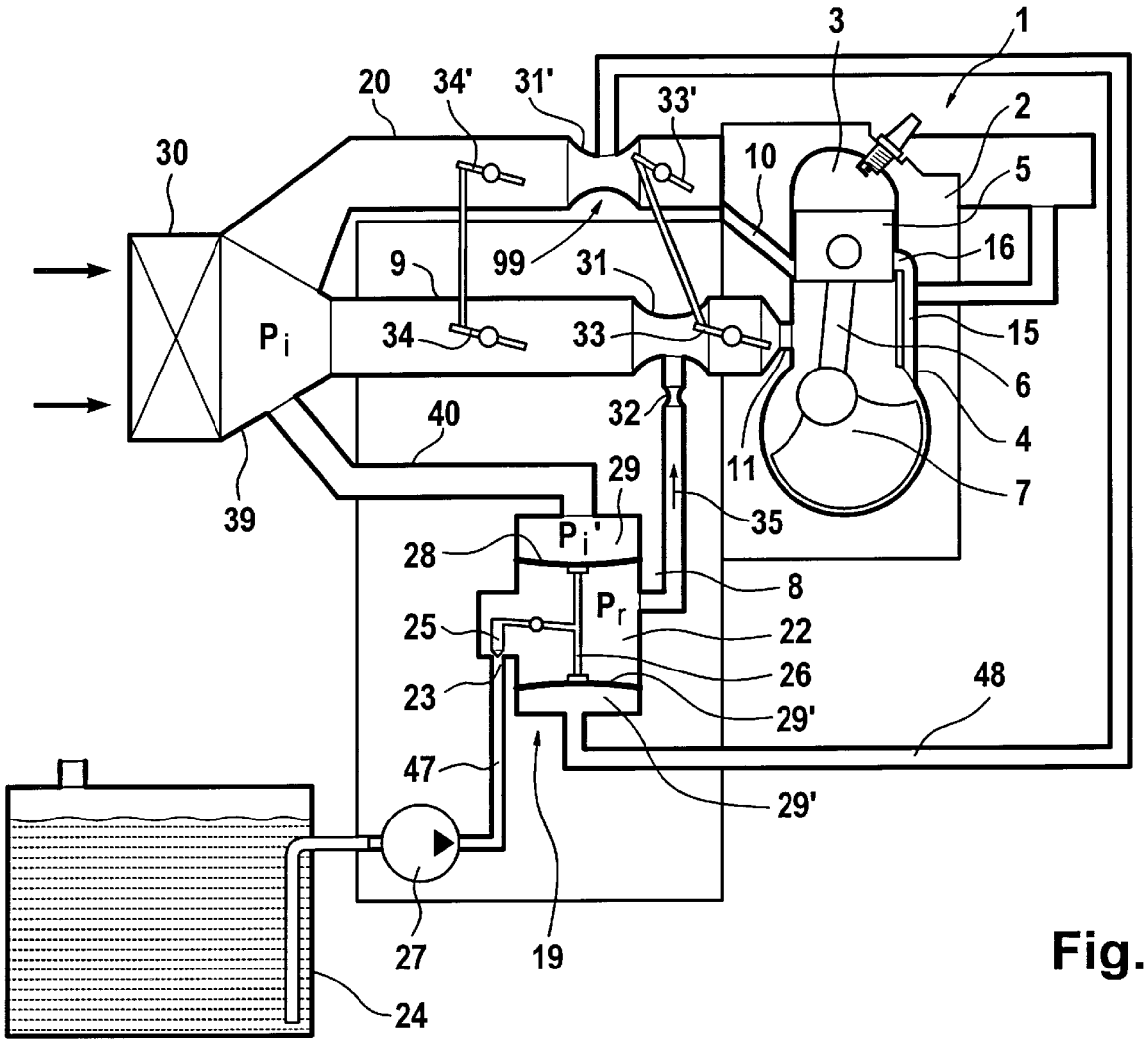
FIG. 7 is a schematic operational diagram of the internal combustion engine of FIG. 1 with an altered configuration to adapt to the CO characteristic curve.

The embodiment of FIG. 7 corresponds in its basic construction to that of the embodiment of FIG. 5, for which reason the same reference numerals are used for the same parts. To compensate for the accumulation of dirt in the filter, the compensation chamber 29 is connected via the flow path 40 with the clean air chamber 39, whereby no control means is arranged in the flow path 40.

As illustrated in FIG. 7, provided in the air channel 20 is a Venturi section 31', similar to the Venturi section 31, whereby downstream of the Venturi section there is arranged a control valve 33' that is coupled in a position-dependent manner with the butterfly valve 33. Similarly, upstream of the Venturi section in the air channel 20 there is disposed a choke valve 34' that is connected in a position-dependent manner with the choke valve 34 in the intake channel 9.

Branching off from the Venturi section 31' is a pressure line 48 that opens out into a compensation chamber 29', which is separated from the fuel-filled control chamber 22 by a control diaphragm 28'. The control diaphragm 28' is connected with the lever mechanism 26 for controlling the feed valve 23; the two control diaphragms 28 and 28' advantageously form a common or cooperative control diaphragm.

A throttling of the pulsating air stream is effected by the Venturi section 31', resulting in a shifting of the average pressure value in the vicinity of the Venturi section. By means of the pressure line 48, the shifted average pressure value is superimposed upon the compensation chamber 29', resulting in a shifting of the carbon monoxide curve as a function of the speed to the curve CO', as shown in FIG. 4. The Venturi section 31' thus forms the mean pressure definer of the control unit 99.

Figure 8:
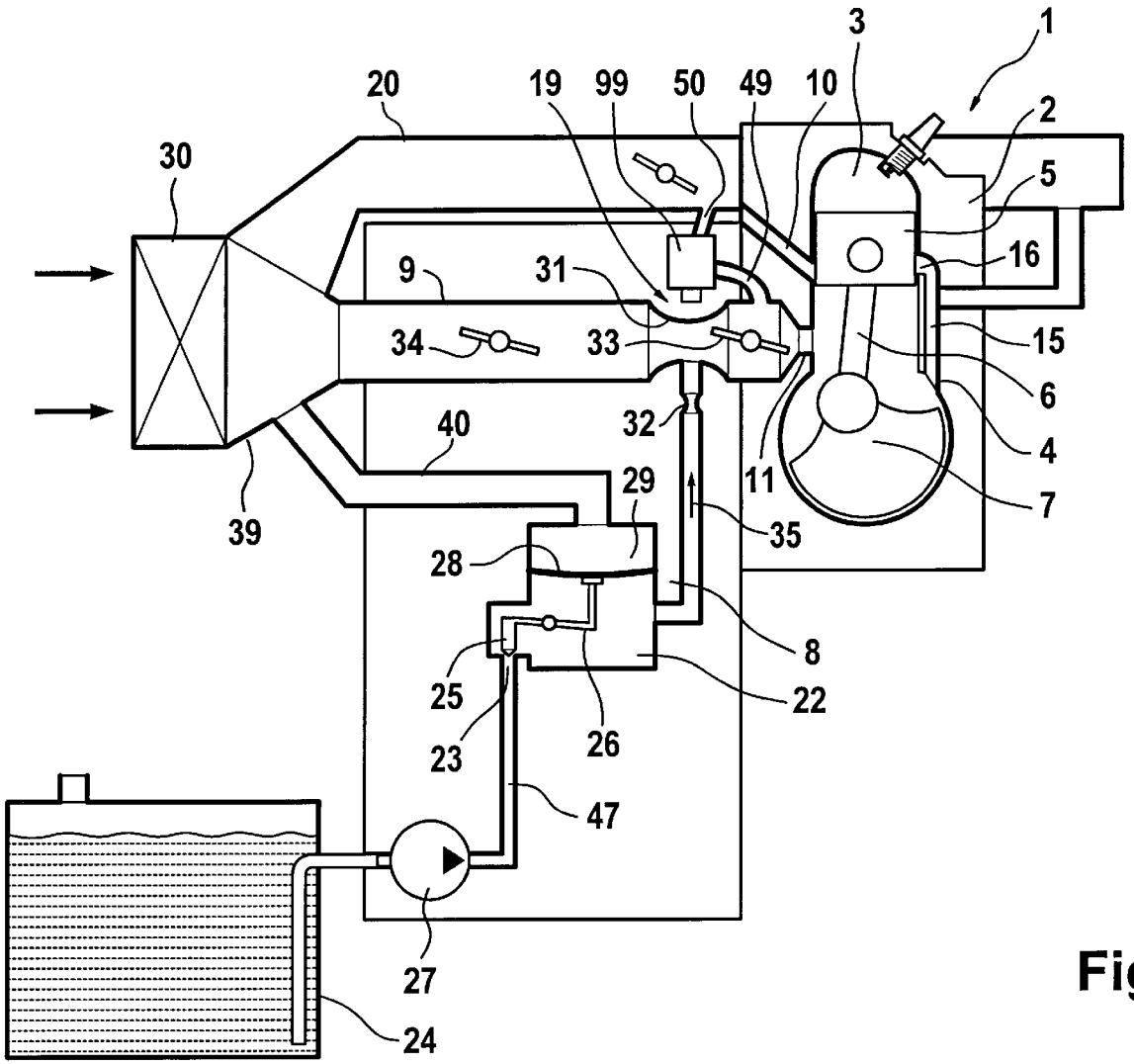
FIG. 8 is a further schematic operational diagram of the internal combustion engine of FIG. 1 showing a further embodiment to adapt to the CO characteristic curve.

The embodiment illustrated in FIG. 8 corresponds in its basic construction to that of the embodiment of FIG. 5, for which reason the same reference numerals are used for the same parts. The compensation chamber 29 of the diaphragm carburetor 8 is connected via the flow path 40 with the clean air chamber 39 of the air filter 30, in order to ensure not only an adaptation to the ambient air pressure but also an adaptation to the pressure conditions as the air filter 30 becomes clogged. No control means are provided in the flow path 40.

To ensure an adaptation of the mixture compensation that is a function of speed, in the embodiment of FIG. 8 the air portion can be adjusted, for which purpose it is possible, for example, to adjust the choke valve 34, or the Venturi section 31 of the intake channel 9 can be embodied as a restrictor having a variable flow cross-section. These means 19 for varying the air portion are controlled by the control unit 99, which can be embodied as a mean pressure definer or a differential pressure definer. The intake pressure that exists close to the inlet is supplied to the control unit 99 via a line 49, and the pressure in the air channel 20 is supplied to the control unit 99 via a line 50. In conformity with the differential pressure that is established, i.e. in conformity with the difference of the average pressure values, the cross-sectional area of the Venturi section is altered in such a way that an enrichment of the mixture is achieved for compensating for the over proportional air portion that is supplied via the air channel 20. In so doing, by altering the cross-sectional area of the Venturi section not only is the volume of air supply altered, but also the intake underpressure is raised to increase the supply of fuel. Instead of disposing the means 19 in the intake channel 9, adjustment means for altering the flow cross-section could also be inserted in the air channel 20. In this connection, it is also conceivable to dispose in the air channel 20 a wind vane, the control magnitude or actuating variable of which is utilized to alter the air or fuel portion in the intake channel 9.

Figure 9:
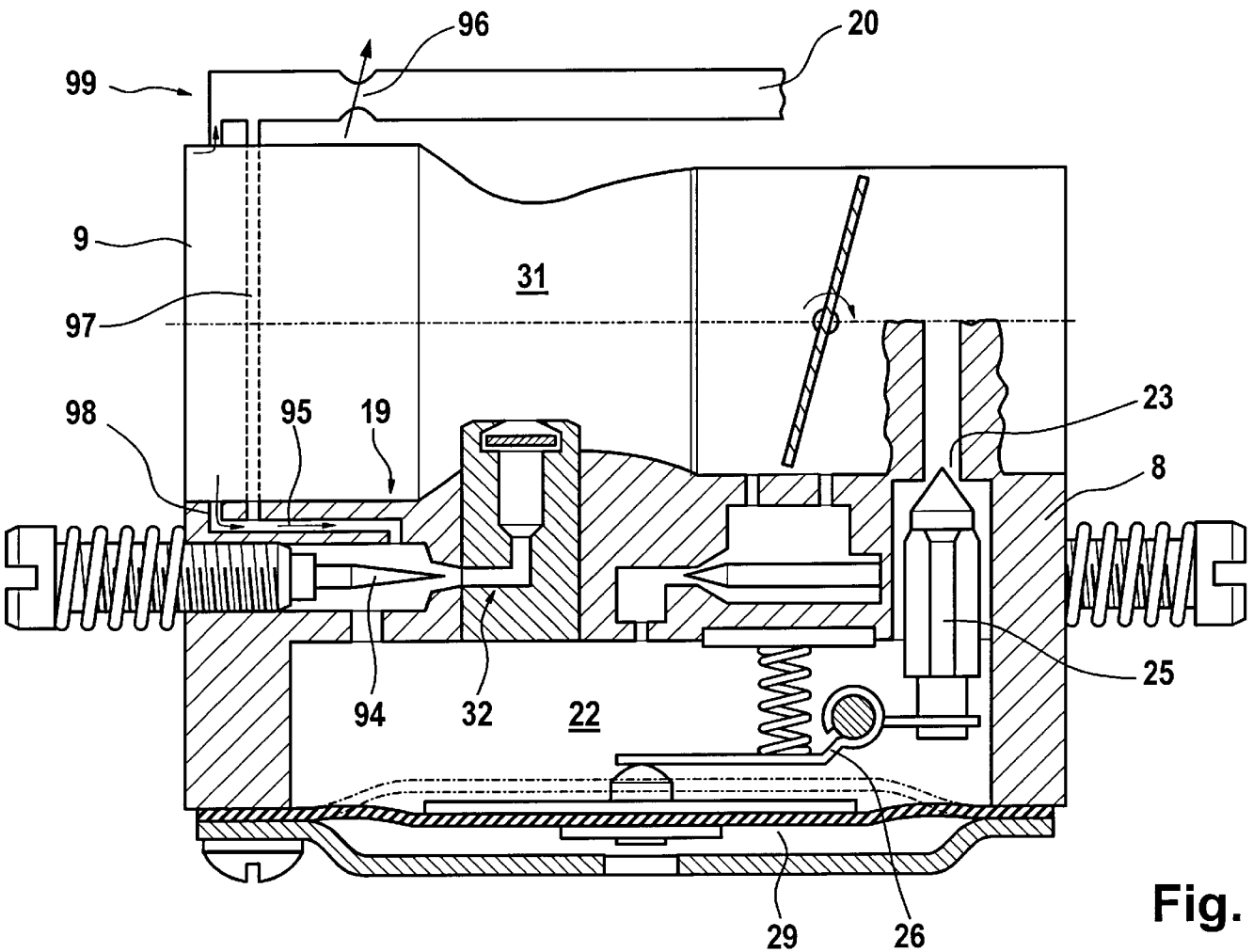
FIG. 9 is a cross-sectional view through a diaphragm carburetor having an air mass stream that opens out into the main nozzle path to influence the CO characteristic curve.

Pursuant to a further specific embodiment of the present invention, an intervention in the supply of fuel can be effected in such a way that at high speeds the fuel supply is reduced by supplying an air mass stream in order then at low speeds to reduce the air mass stream, as a result of which there is achieved an enrichment of the mixture to compensate for the over proportional amount of air that is being supplied. As shown in FIG. 9, the control unit 99 is again embodied as a mean pressure definer, to which is conveyed on the one hand a pressure signal from the air channel 20 and on the other hand a pressure signal from the intake channel 9. For this purpose, provided upstream of the Venturi section 31, about the periphery of the intake channel 9, are a plurality of tapping openings 98 that together feed into an annular channel 97 that opens out into the main nozzle path 32. The throttle or pressure-regulating means 96 disposed at the control unit 99 is adjustable in order to regulate a combining of the pressure signal from the air channel 20 and the pressure signal from the intake channel 9, which combining corresponds to the desired shifting of the CO characteristic curve.

The air mass stream 95 can open out into the main nozzle path 32 either upstream of a preferably adjustable throttle 94 or, as indicated by dashed lines, downstream of the throttle 94.

As the various embodiments show, it is possible with surprisingly straightforward means to establish an approximately uniform lambda over the entire speed range, under full load, in the combustion chamber of an internal combustion engine having scavenging collection or charge stratifying, whereby the carbon monoxide portion, which is approximately proportional to the magnitude for lambda, is advantageously set in a range between 0.5% to 11%.

The specification incorporates by reference the disclosure of German priority document 101 04 446.1 of Feb. 1, 2001.

The present invention is, of course, in no way restricted to the specific disclosure of the specification and drawings, but also encompasses any modifications within the scope of the appended claims.

We claim:

1. An internal combustion engine, which has a cylinder in which is formed a combustion chamber that is delimited by a reciprocating piston that drives a crankshaft which is rotatably mounted in a crankcase, said engine further comprising:

a diaphragm carburetor for supplying to said internal combustion engine a fuel/air mixture that is prepared in a Venturi section of said diaphragm carburetor, wherein an air portion of said mixture is conveyed to said Venturi section via an intake channel, and a fuel portion of said mixture is conveyed to said Venturi section via a main nozzle that branches off from a fuel-filled control chamber of said diaphragm carburetor, wherein said control chamber is supplied with fuel via a fuel line and a feed valve, and wherein said feed valve is controlled by a control diaphragm that delimits said control chamber;

a control unit that receives, as an input variable, an operating parameter of said internal combustion engine that varies as a function of engine speed; and means connected to said control unit for varying at least one of said air portion and said fuel portion of said mixture at full load for an adaptation of a composition of said mixture at full load as a function of engine speed, wherein as a function of an output signal of said control unit, said means for varying is actuated in such a way as to establish, under full load, an approximately uniform lambda in said combustion chamber over the entire speed range of said internal combustion engine.

2. An internal combustion engine according to claim 1, wherein the value for lambda is selected such that under full load, a carbon monoxide portion of approximately 0.5 to 11% is established in the exhaust gas of said internal combustion engine over an entire speed range of said engine.

3. An internal combustion engine according to claim 1, wherein under full load, said fuel/air mixture is enriched in a lower speed range.

4. An internal combustion engine according to claim 1, wherein as said input variable, a pressure signal of a system pressure is utilized.

5. An internal combustion engine according to claim 4, wherein said system pressure is at least one of the group consisting of the pressure in said intake channel, a pressure in an air channel, and a pressure in an air filter.

6. An internal combustion engine according to claim 5, wherein a further Venturi section is disposed in said air channel, and wherein said pressure signal is derived at said further Venturi section.

7. An internal combustion engine according to claim 1, wherein said output signal of said control unit is a pressure signal that is sent indirectly or directly to said control diaphragm of said diaphragm carburetor.

8. An internal combustion engine according to claim 1, wherein said output signal of said control unit controls an adjustment member that adjusts a flow restrictor that alters said air portion.

9. An internal combustion engine according to claim 8, wherein a fuel-containing mixture is supplied to said combustion chamber of said internal combustion engine via said diaphragm carburetor, and wherein essentially fuel-free air for combustion is supplied to said combustion chamber via an air channel.

10. An internal combustion engine according to claim 8, wherein an air filter is disposed upstream of said diaphragm carburetor, and wherein said pressure signal is derived from a clean air chamber of said air filter.

11. An internal combustion engine according to claim 8, wherein said pressure signal is an average value of the pressure in said air channel and the pressure at a different pressure location of the overall system.

12. An internal combustion engine according to claim 11, wherein said pressure at a different pressure location is an intake pressure in said intake channel.

13. An internal combustion engine according to claim 11, wherein said pressure signal is an average value of the pressure in said air channel and the pressure at a different pressure location of the overall system.

14. An internal combustion engine according to claim 13, wherein said pressure at a different pressure location is an intake pressure in said intake channel.

15. An internal combustion engine according to claim 1, wherein said output signal of said control unit is an air mass stream that is supplied to said main nozzle path.

16. An internal combustion engine according to claim 15, wherein a throttle is disposed in said main nozzle path, and wherein said air mass stream opens out downstream of said nozzle.

17. An internal combustion engine according to claim 16, wherein said throttle is adjustable.

18. An internal combustion engine according to claim 15, wherein said air mass stream is supplied to said main nozzle path from an air channel leading from an intake tube to said Venturi section in said intake channel.

* * * * *